US010294049B2

(12) United States Patent
Srnka et al.

(10) Patent No.: US 10,294,049 B2
(45) Date of Patent: May 21, 2019

(54) CONSUMABLE CARRIER WITH CODE READER

(71) Applicant: Codonics, Inc., Middleburg Heights, OH (US)

(72) Inventors: Lawrence Srnka, Northfield Center, OH (US); Kevin S. Litvak, Parma, OH (US); Christopher Tainer, Strongsville, OH (US); Peter Adam, Kirkland, WA (US); Arlber Chang, Middleburg Heights, OH (US)

(73) Assignee: CODONICS, INC., Middleburg Heights, OH (US)

( * ) Notice: Subject to any disclaimer, the term of this patent is extended or adjusted under 35 U.S.C. 154(b) by 0 days.

(21) Appl. No.: 15/507,513

(22) PCT Filed: Sep. 8, 2015

(86) PCT No.: PCT/US2015/048878
§ 371 (c)(1),
(2) Date: Feb. 28, 2017

(87) PCT Pub. No.: WO2016/037176
PCT Pub. Date: Mar. 10, 2016

(65) Prior Publication Data

US 2017/0247213 A1 Aug. 31, 2017

Related U.S. Application Data

(60) Provisional application No. 62/046,246, filed on Sep. 5, 2014.

(51) Int. Cl.
*B65H 1/04* (2006.01)
*B65H 1/26* (2006.01)

(52) U.S. Cl.
CPC ..... *B65H 1/04* (2013.01); *B65H 1/266* (2013.01); *B65H 2405/111* (2013.01); *B65H 2553/52* (2013.01)

(58) Field of Classification Search
CPC ..... B65H 2553/52; B65H 2701/1244; B65H 2511/40; B65H 2511/412; B65H 2511/416; B65H 1/04; B41J 2029/3937
See application file for complete search history.

(56) References Cited

U.S. PATENT DOCUMENTS 8,028,985 B2 * 10/2011 Campbell ..... B65H 1/266 271/145
8,181,873 B2 * 5/2012 Ashizaki ..... G06K 7/10178 235/449

(Continued)

FOREIGN PATENT DOCUMENTS

WO 2005/091236 A1 9/2005

OTHER PUBLICATIONS

International Search Report for PCT/US2015/048878 dated Dec. 17, 2015.

*Primary Examiner* — Michael C McCullough
(74) *Attorney, Agent, or Firm* — Kraguljac Law Group, LLC

(57) ABSTRACT

Provided is a container for transporting a consumable such as a medium on which an image is to be printed. The container includes a support surface and a reading component coupled to the support surface to read a computer-readable code accompanying the consumable. A relay interface is operatively connected to the reading component to receive a signal indicative of the computer-readable code read by the reading component, and communicate with a compatible reader provided to the receiving apparatus to convey information about the computer-readable code read by the reading component to the receiving apparatus. The (Continued)

relay interface can be coupled to the tray at a location remotely located from the reading component and having an orientation that is different from an orientation of the reading component.

15 Claims, 7 Drawing Sheets

(56) References Cited

U.S. PATENT DOCUMENTS

| | | | | |
|---|---|---|---|---|
| 2003/0076520 | A1* | 4/2003 | Haines | B41J 2/17546 358/1.12 |
| 2005/0151823 | A1 | 7/2005 | Botten | |
| 2009/0084846 | A1* | 4/2009 | Ashizaki | G06K 7/10178 235/451 |

* cited by examiner

CONSUMABLE CARRIER WITH CODE READER

CROSS-REFERENCE TO RELATED APPLICATIONS

This application claims the benefit of U.S. Provisional Application No. 62/046,246, filed Sep. 5, 2014, which is incorporated in its entirety herein by reference.

BACKGROUND OF THE INVENTION

1. Field of the Invention

This application relates generally to a tray, container or other carrier of consumables that can be used to identify the consumable therein and, more specifically, to a method and apparatus for relaying information encoded by a computer-readable code identifying the consumables in the tray, container or other carrier to a reader.

2. Description of Related Art

As an example of a component carrier, a media tray is commonly used to store printing media such as paper, film, and other types of media on which hardcopies of images, text and other printable content are created. To load a printer with media, the media tray is inserted into a media bay from where the printer can retrieve the blank media, on demand, each time a hardcopy is to be generated. However, users must manually identify the specific media in the tray loaded into a printer that can utilize two or more different types and/or sizes of media.

BRIEF SUMMARY OF THE INVENTION

Accordingly, there is a need in the art for a media tray or other carrier of consumables that can be utilized to interrogate or read a computer-readable code accompanying the consumables within the tray to identify at least one characteristic of the consumables.

According to one aspect, the subject application involves a container for transporting a consumable. The container includes a support surface on which the consumable to be introduced to a receiving apparatus is supported, and a reading component coupled to the support surface to read a computer-readable code accompanying the consumable supported by the support surface. A relay interface is operatively connected to the reading component to receive a signal indicative of the computer-readable code read by the reading component and communicate with a compatible reader provided to the receiving apparatus to convey information about the computer-readable code read by the reading component to the receiving apparatus. The relay interface is coupled to the tray at a location remotely located from the reading component and having an orientation that is different from an orientation of the reading component.

According to another aspect, the subject application involves a media cartridge for storing a consumable medium on which content is to be rendered utilizing a hardcopy product apparatus for generating a hardcopy of the content. The media cartridge according to the present aspect includes a housing comprising support surface on which the consumable medium rests and a perimeter wall that extends upwardly, from a portion of a periphery of the support surface to define a cavity in which the medium is to be stored for consumption by the hardcopy production apparatus. A first reading component is coupled to the housing and includes an interrogation antenna that emits an interrogation signal in response to being energized to read a computer-readable code stored by a storage device accompanying the consumable medium. The interrogation antenna includes a first orientation relative to the housing. A relay interface is operatively connected to communicate with the first reading component and includes a relay antenna in a second orientation relative to the housing that is different from the first orientation of the interrogation antenna. In response to receiving a signal from a compatible reader provided to the hardcopy production apparatus with the relay antenna, the relay interface transmits an energizing signal to energize the interrogation antenna and initiate reading of the computer-readable code.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
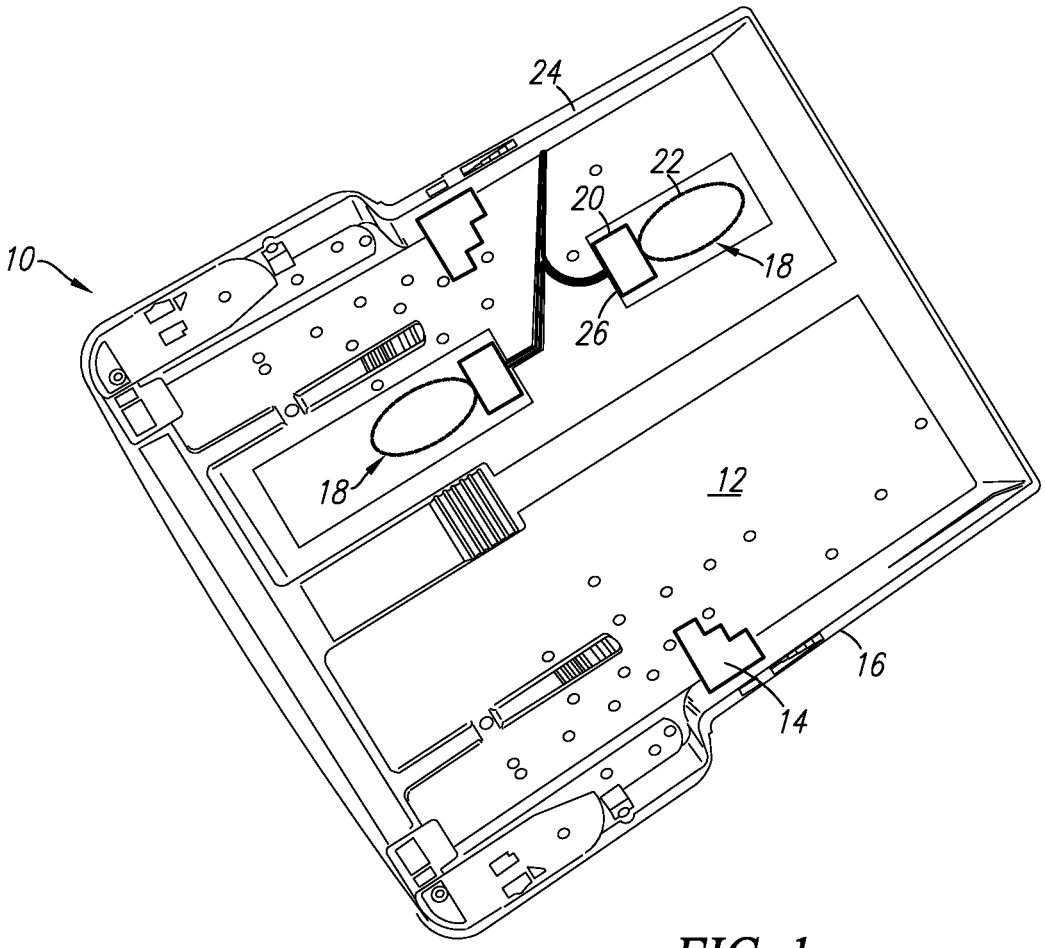
FIG. 1 shows a top view of an illustrative embodiment of a media cartridge including a plurality of reading components at different locations operatively connected to communicate with a common relay interface.

Certain terminology is used herein for convenience only and is not to be taken as a limitation on the present invention.

Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1 shows a top view of a media cartridge 10 as an example of a container for transporting a consumable such as film or paper, for example. Although any container that stores a consumable item is within the scope of the present disclosure, for the sake of brevity the container will be described with reference to the media cartridge 10 storing film to be supplied to a medical imager 32 (FIG. 3) for generating hardcopy images on film (e.g., x-ray images, CT scan images, other medical images for diagnostic purposes, etc.). An example of such a medical imager 32 is the Horizon® multi-media imager from Codonics, Inc.

As shown in FIG. 1, the media cartridge 10 forms a housing that includes a support surface 12 on which the film or other consumable medium to be introduced to the medical imager 32, an office printer, or other receiving apparatus that consumes media is to be supported. The support surface 12 can be substantially planar, optionally including one or more apertures 14 granting access to an interior of the media cartridge 10 while the media cartridge 10 is in use. A perimeter wall 16 extends upwardly from the support surface 12, along a portion (e.g., entirely about; along at least some; or most, but less than all) of the periphery of the support surface 12 to define a cavity-like recess in which the consumable medium is to be placed, and from where it can be retrieved by the medical imager 32. The peripheral wall forms an angle of ten (10°) degrees relative to the support surface 12, but can be at least forty five (45°) degrees or approximately ninety (90°) degrees relative to the support surface 12, without departing from the scope of the present disclosure.

The media cartridge 10 also includes at least one reading component 18 coupled to the housing at a location such as a portion of the support surface 12. The reading component 18 can be a RFID reader terminal, for example. For such embodiments, the reading component 18 includes an electronic circuit 20 that controls delivery of an alternating interrogation signal to an interrogation antenna 22 in the form of a loop of an electrically-conductive material such as copper to generate an alternating electromagnetic field that is used to excite a compatible antenna provided with the media in the cartridge 10, and receipt of a computer-readable code emitted by the corresponding antenna excited by the electromagnetic field in return. More specifically, this field generated by the interrogation antenna can be used to inductively generate a current through a compatible antenna provided to a RFID tag accompanying the film or other print media resting on the support surface 12 and storing the computer-readable code. The RFID tag can optionally be adhered or otherwise coupled to an optional liner made of paper or other suitable material that separates the film from the support surface 12, placed between the film or other media from the support surface 12, or otherwise inserted into the cartridge 10 along with the film or other media. Such a current inductively generated in the antenna of the RFID tag accompanying the film in response to being exposed to the field generated by the interrogation antenna 22 is sufficient to temporarily energize a circuit including a computer-readable memory (e.g., solid state memory) provided to the RFID tag accompanying the film. Once energized, this circuit transmits the computer-readable code identifying the film stored in the memory by modulating the current flowing through the antenna provided to the RFID tag to emit a suitable response signal, or otherwise transmitting the code as a signal through the antenna of the RFID tag, which also generates a field that is sensed by the interrogation antenna 22 provided to the reading component 18, thereby allowing the reading component to "read" the computer-readable code from the RFID tag accompanying the film.

Figure 2:
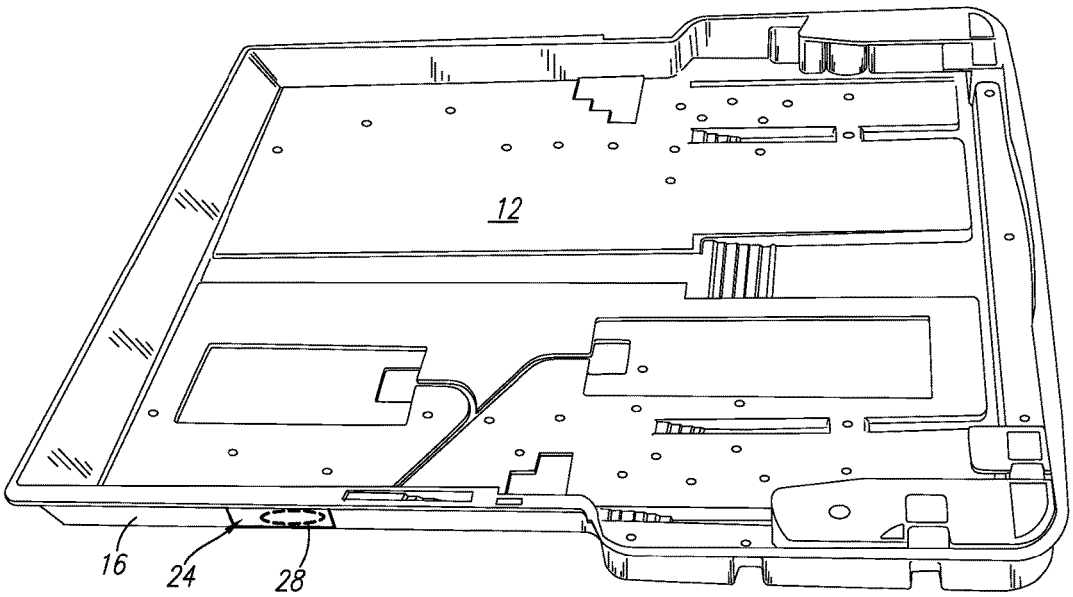
FIG. 2 shows a perspective view of the illustrative embodiment of the media cartridge appearing in FIG. 1.

Since the reader component 18 lacks an onboard, robust power supply and communication circuitry that would facilitate active communications with a RFID reader 36 provided to a lateral side of the medical imager 32 as discussed below with reference to FIGS. 3 and 4, the RFID reader 36 of the medical imager 32 does not communicate directly with the reading component 18 wirelessly (e.g., inductively). Further, the medical imager 32 shown in FIG. 3 can receive a plurality of different media cartridges 10 in a vertically-stacked arrangement, each storing a different imaging medium accompanied by RFID tags storing different computer-readable codes identifying those media. The RFID reader 36 of the imager 32 does not generate a field of sufficient strength to interrogate the RFID tags accompanying the different media cartridges 10 directly because such a wide-range field would interrogate more than one RFID tag, and would not differentiate the data sent in return, which could include multiples of the same computer-readable code. And since the media cartridge(s) 10 is/are removable, there are no hardwired connections between the reading component 18 of each media cartridge 18 and the RFID reader provided to the medical imager 32. To allow for the use of a relatively low-power interrogation signal to limit the range of interrogation to a specific media cartridge 10 (e.g., and not interrogate the RFID tag provided to more than one cartridge), the media cartridge 10 can also include a relay interface 24, also shown in FIG. 2.

As shown, the reading component 18 is coupled to the support surface 12 inward of the of the perimeter wall 16 extending along the portion of the periphery of the support surface, and the relay antenna is coupled to the perimeter wall 16, at the periphery of the support surface 12. The reading component 18 can even be arranged adjacent to a central region of the support surface 12. The relay interface 24 can be hardwired with wires 26 made of an electrically-conductive material optionally embedded in the support surface 12 (e.g., disposed to run within longitudinal channels formed in the support surface 12), or otherwise operatively connected to communicate with the reading component 18. Like the reading component 18, the relay interface 24 includes a relay antenna 28 in an orientation relative to a portion of the housing such as the support surface 12, for example, that is different from the orientation of the interrogation antenna 22 relative to that same portion (e.g., the support surface 12). In this manner, the interrogation antenna 22 of the reading component 18 can be arranged to be substantially parallel with a major plane of the consumable medium supported by the support surface 12, allowing the interrogation antenna 22 to be substantially parallel with the antenna of the RFID tag accompanying the print medium in the media cartridge 10. The relay antenna 28 can thus be arranged approximately orthogonal to the interrogation antenna 22, yet communication between the relay component 24 and the RFID reader provided to the medical imager 32 through RF communication can be established.

Figure 3:
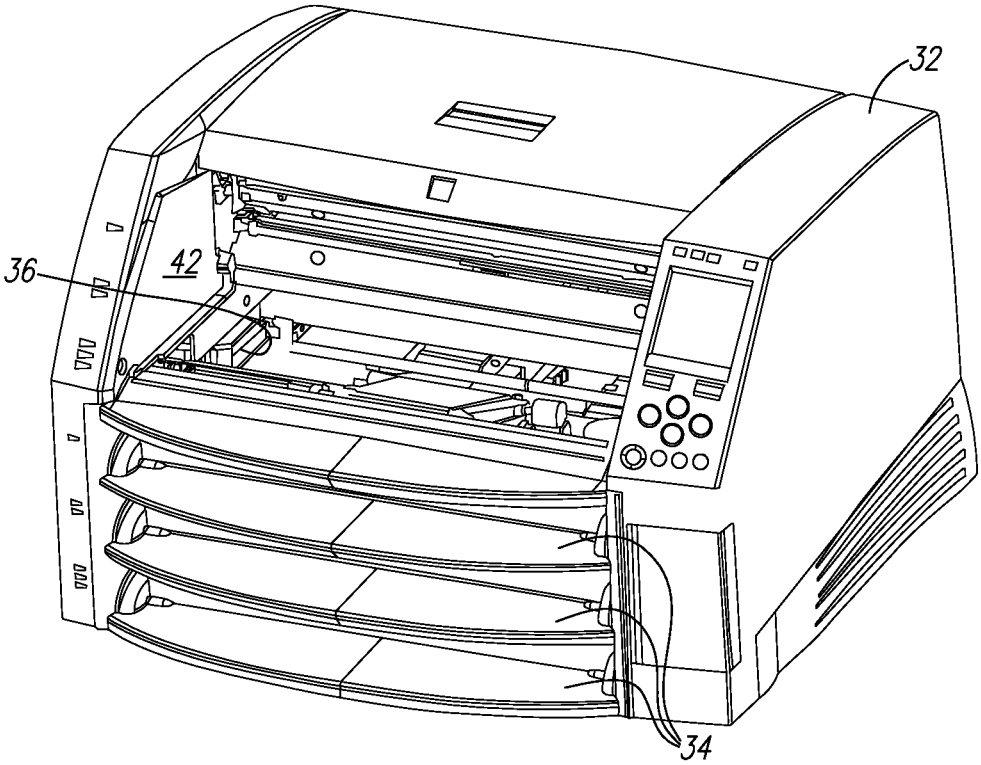
FIG. 3 shows a perspective view of a media imager comprising a plurality of vertically-arranged media bays and a contactless, computer-readable code reader provided adjacent to a lateral side of each of the media bays.
Figure 4:
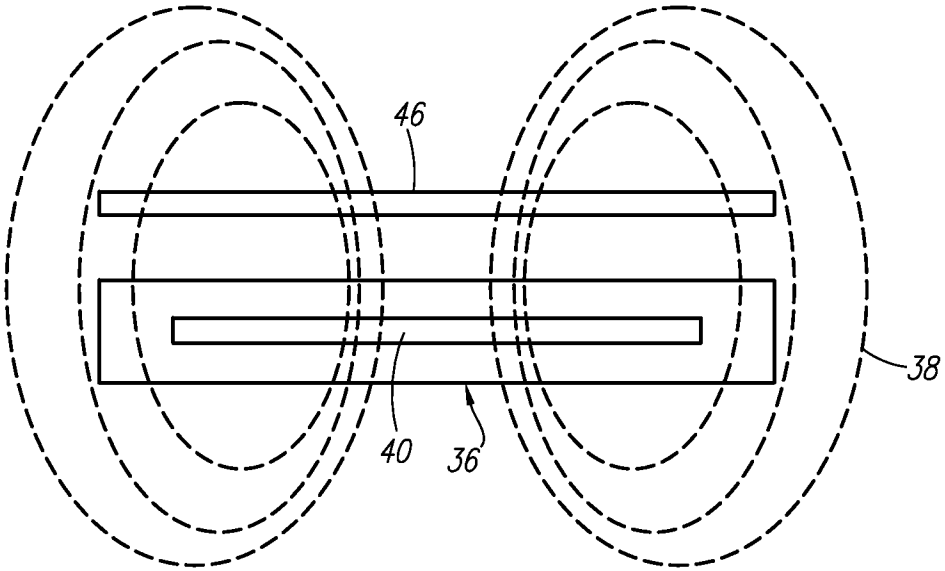
FIG. 4 shows a schematic representation of an arrangement of an antenna relative to a RFID tag for directly reading data stored by the RFID tag.

For the medical imager 32 appearing in FIG. 3, space considerations between a plurality of vertically-aligned media bays 34 provided to the imager 32 may prevent a RFID reader 36 from being positioned on the medical imager 32 adjacent to, and parallel with the support surface 12 of the media cartridge 10. Ideally, and as schematically illustrated in FIG. 4, a RFID reader 36 positioned as such would be parallel with the support surface 12, and emit an excitation field 38 extending generally perpendicular to, or at least outwardly from the plane in which a coil RFID antenna 40 of the RFID reader 36 is arranged. The excitation field 38 for such an arrangement would induce a current through an antenna provided to the RFID tag 46 accompanying the film or other print media on the support surface 12, thereby temporarily energizing the circuitry of that RFID tag 46 to emit a signal indicative of the type of film and/or other quality of the media contained by the media cartridge 10. However, due to the limited space between the media bays 34 shown in FIG. 3, arranging the RFID reader 36 in this manner between the media bays 34 may not be practical, or even possible.

Figure 5:
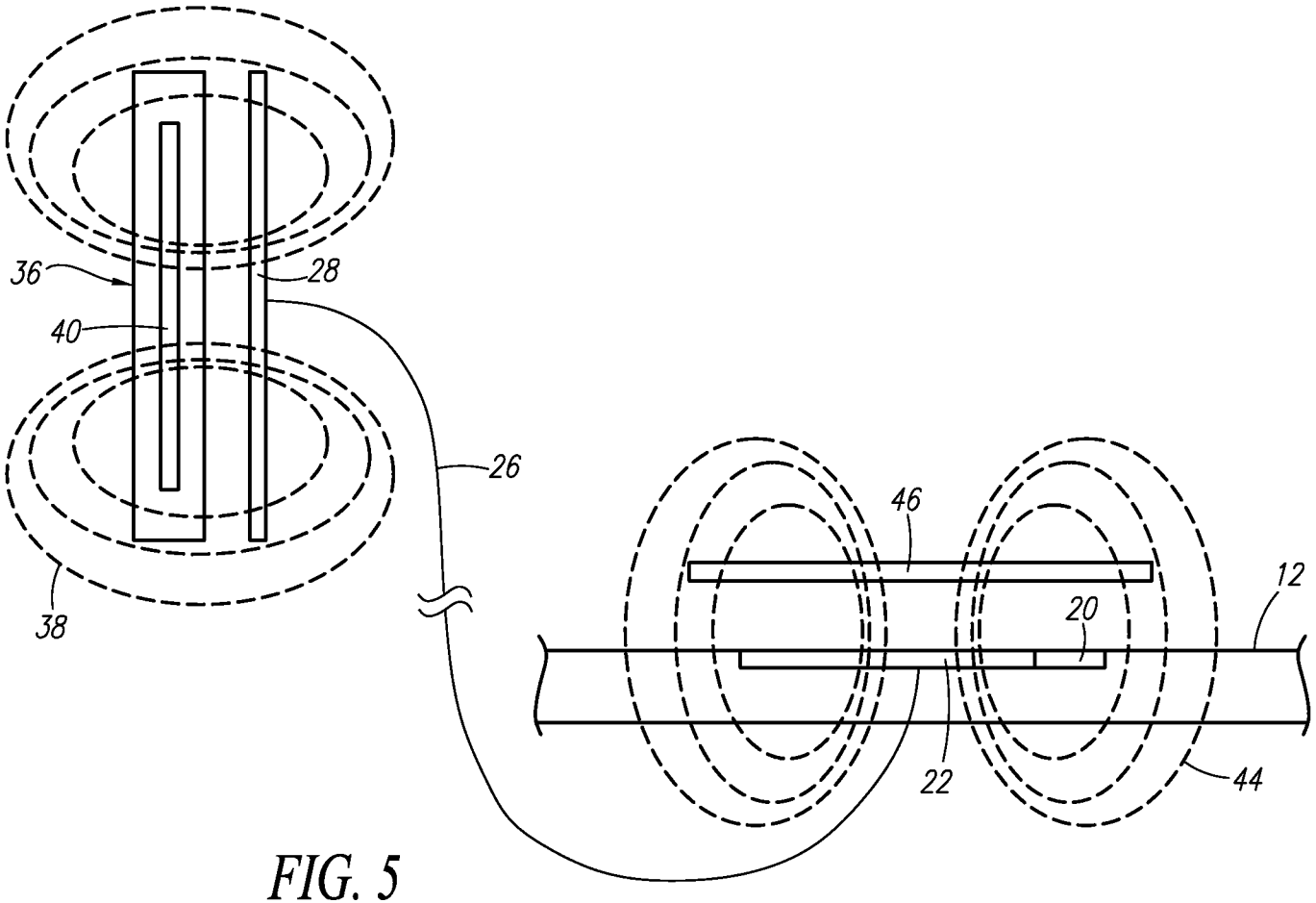
FIG. 5 shows a schematic representation of an arrangement of an antenna relative to a RFID tag for reading data and/or updating data stored by the RFID tag utilizing a relay interface having an orientation other than parallel to the RFID tag for indirectly reading and/or updating the data via the relay interface.

Instead, the media cartridge 10 discussed herein allows for the installation of the RFID reader 36, or other computer-readable code reader, adjacent to a lateral side 42 of a receiving bay 34 where the media cartridge(s) 10 is/are to be inserted, as shown in FIG. 3. The medical imager 32 can optionally include a sensor that detects when a media cartridge 10 is inserted. In response to detection insertion of the media cartridge 10, the RFID reader 36 can be energized using power supplied to the medical imager 32 through a conventional AC mains wall outlet to conduct a current through the antenna 40 and generate the field 38, as shown in FIG. 5. The field 38 emitted by the RFID reader 36 provided to the medical imager 32 induces a current through the relay antenna 28 of the relay interface 24 which, in turn, transmits an energizing signal that is conducted by the wires 26 to the reading component 18 to energize the interrogation antenna 22, which is arranged substantially orthogonal to the relay antenna 28 on the media cartridge 10 according to the present embodiment. In response to being energized, the interrogation antenna 22 emits a field 44 similar to the field 38 emitted in response to energizing the antenna 40 to initiate reading of the computer-readable code stored by the RFID tag 46 accompanying the print medium stored by the media cartridge 10. This field emitted by the interrogation antenna 22 induces a current in the antenna provided to the RFID tag 46 accompanying the media contained by the media cartridge 10, which can be used to temporarily energize an onboard circuit provided to RFID tag 46. Once energized, the circuit provided to the RFID tag 46 can read and/or update data stored by a computer memory provided to the RFID tag 46. If data is read, this read data is returned as a modulated version of the field 44, which is sensed by the interrogation antenna 22 and, in turn, conducted back to the relay interface 24 via the wires 26, from where it can be wirelessly transmitted as a modulated field 38 back to the antenna 40 provided to the RFID reader 36 on the medical imager 32.

Examples of the data that can be read from and/or stored to the RFID tag 46 utilizing the present media cartridge include, but are not limited to at least one of: a type of media contained in the media cartridge 10, a quantity of media contained in the media cartridge, a source (e.g., a manufacturer) of the media contained in the media cartridge, and a quality or any other specification relating to the media contained in the media cartridge 10.

Due to the different orientation of the relay antenna 28 relative to the interrogation antenna 22, the present media cartridge 10 provides added flexibility for the location of the RFID reader 36 provided to the medical imager 10.

According to alternate embodiments, the support surface 12 can also include a second reading component 30 operatively connected to the relay interface 24 via wires 26. The second reading component 30 can be coupled to the support surface 12 at a second location inward of the perimeter wall 16 that is different from the location of the reading component 18. Thus, different media may be accompanied by RFID tags at different locations. To render the media cartridge 10 compatible with such different media, a reading component can be provided at each location where the RFID tag accompanying the different media is expected to be positioned.

Each of the embodiments described above involves the use of a passive system to read a computer-readable code accompanying a medium contained by the cartridge 10 to allow the imager 32 or other hardcopy production device to identify that medium. As such, the cartridge 10 lacked an onboard power supply such as a battery or interface that electrically connects the cartridge 10 to the imager 32. However, according to alternate embodiments, the cartridge 10 can include a battery provided to the relay interface 24, the reading component 18, or other component; or include an electrical connector that establishes electrical continuity between an external power source (e.g., a power supply provided to the imager 32) and the relay interface 24 and/or reading component 18 to create an "active" repeating system. Such active systems include a relay interface 24 that communicates wirelessly with the RFID reader 36, but can actively process and facilitate with the RFID tag accompanying the medium in the cartridge 10 using the available power supply, and without being energized by current induced by the RFID reader 36.

Figure 6:
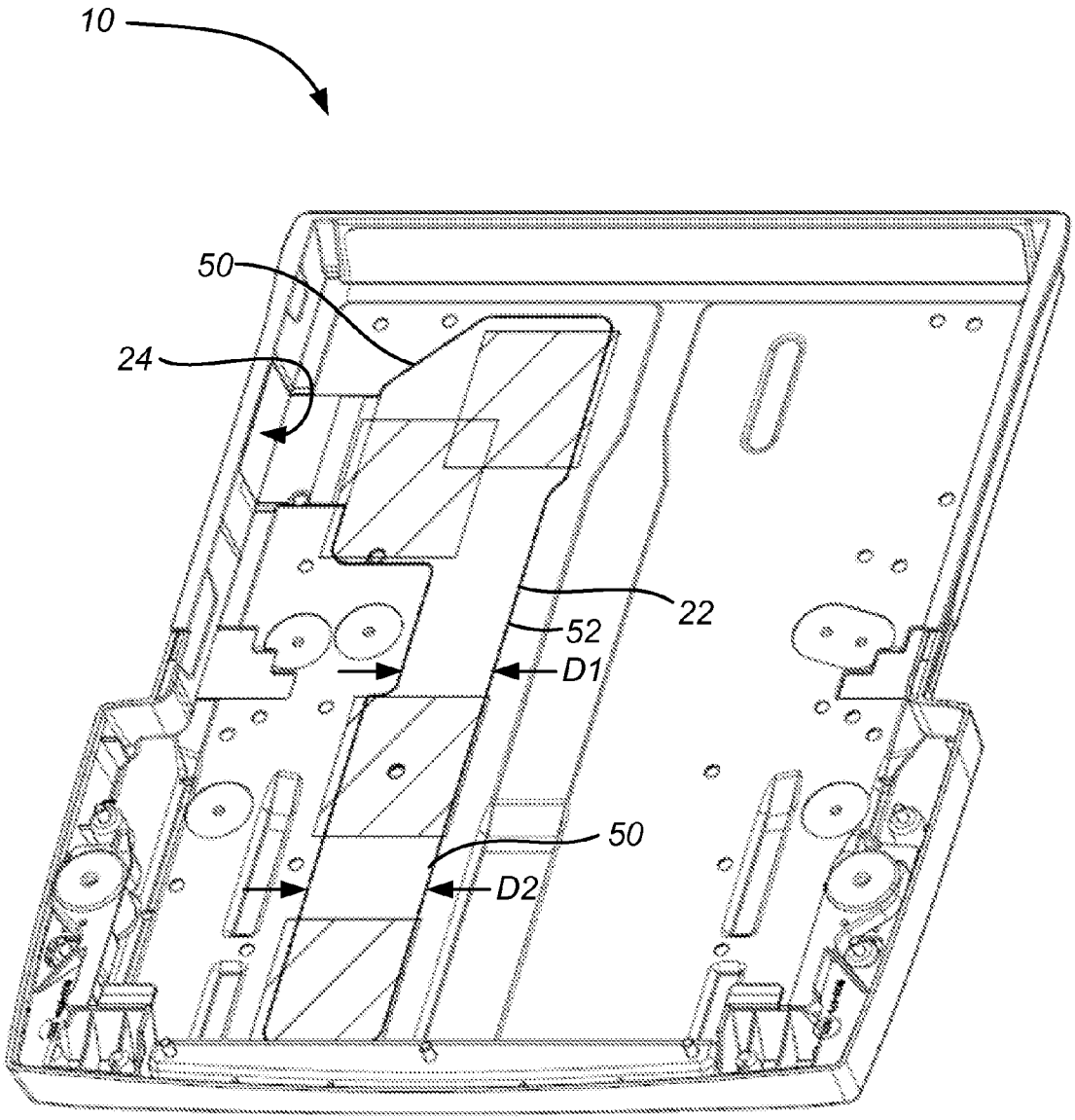
FIG. 6 shows a perspective view of an alternate embodiment of a media cartridge including a single interrogation antenna configured to establish a plurality of reading regions at different locations along a bottom surface of a media cartridge operatively connected to communicate with a common relay interface.

An alternate embodiment of a media cartridge 10 is shown in FIG. 6. The embodiments discussed above utilize one interrogation antenna 22 to communicate with a RFID tag arranged at a fixed location corresponding to that interrogation antenna 22. A plurality of distinct interrogation antennas 22 can be arranged along the support surface 12 at different locations as shown in FIG. 1 to support communications with RFID tags at a plurality of respective locations above those interrogation antennas 22. As shown in FIG. 6, however, the cartridge 10 includes a single, continuous interrogation antenna 22 configured to extend about, and establish a plurality of reading regions 50 at different locations along a support surface 12 of the media cartridge 10. Thus, the plurality of different reading regions 50 established by the interrogation antenna 22 are operatively connected to communicate with a common relay interface 24.

Each reading region 50 can correspond to a location defined by a "loop" formed by the interrogation antenna 22 vertically below where the RFID tag is expected to be arranged with the medium in the cartridge 10 to be read. For the embodiment in FIG. 6, there are two reading regions 50 arranged to read the computer-readable code from an RFID tag arranged in the cartridge 10 vertically above those reading regions 10, or within reasonably-close proximity thereof to allow for the interrogation of the RFID tag described herein to be performed. Although referred to as being defined by "loops", the reading regions 50 do not necessarily have to be perfectly circular in shape or be fully enclosed, but merely have to form a continuous periphery that defines a majority of a complete enclosure. For the example shown in FIG. 6, each loop is somewhat rectangular in shape when viewed from directly above the reading regions 50, and form approximately three of four sides (3/4) of an enclosed rectangle, with openings leading to an intervening low-intensity region 52 separating the reading regions 50.

Separating at least two reading regions 50 can be a low-intensity region 52 where the spacing separating regions of the conductive material forming the interrogation antenna 22 is less than the spacing of that material forming the reading regions 50 separated by the low-intensity region 52. This material can be, for example, a co-axial cable, a controlled impedance PCB strip line, twisted pair wires, or any other connection system that effectively transmits energy and data between the relay antenna 28 and the interrogation antenna 22. For the illustrative embodiment shown in FIG. 6, the distance D1 separating the material forming the low-intensity region 52 is less than the distance D2 between the antenna material on opposite sides of a "loop" to establish the reading region 50 on either side of the low-intensity region 52.

The interrogation antenna material is configured in to low-intensity regions 52 to minimize magnetic field flux. This is achieved by pinching down opposing polarities of the target antenna into tightly-coupled differential pair traces, for example. The result of this antenna shaping is to maximize field flux and energy density in the regions vertically above the reading regions 50 where the RFID tag identifying the medium in the cartridge 10 are expected to be located and minimize energy density in other regions where the RFID tags are not expected to be located. Due to the low-energy levels of the current induced by the RFID reader 36, the relatively-large loops of the interrogation antenna 22 achieve suitable energy transfer and communication signal strength to read the computer-readable code from the RFID tag identifying the medium in the cartridge 10. In contrast, the low-intensity regions 52 do not achieve suitable energy transfer and communication signal strength to read the computer-readable code from the RFID tag.

Figure 7:
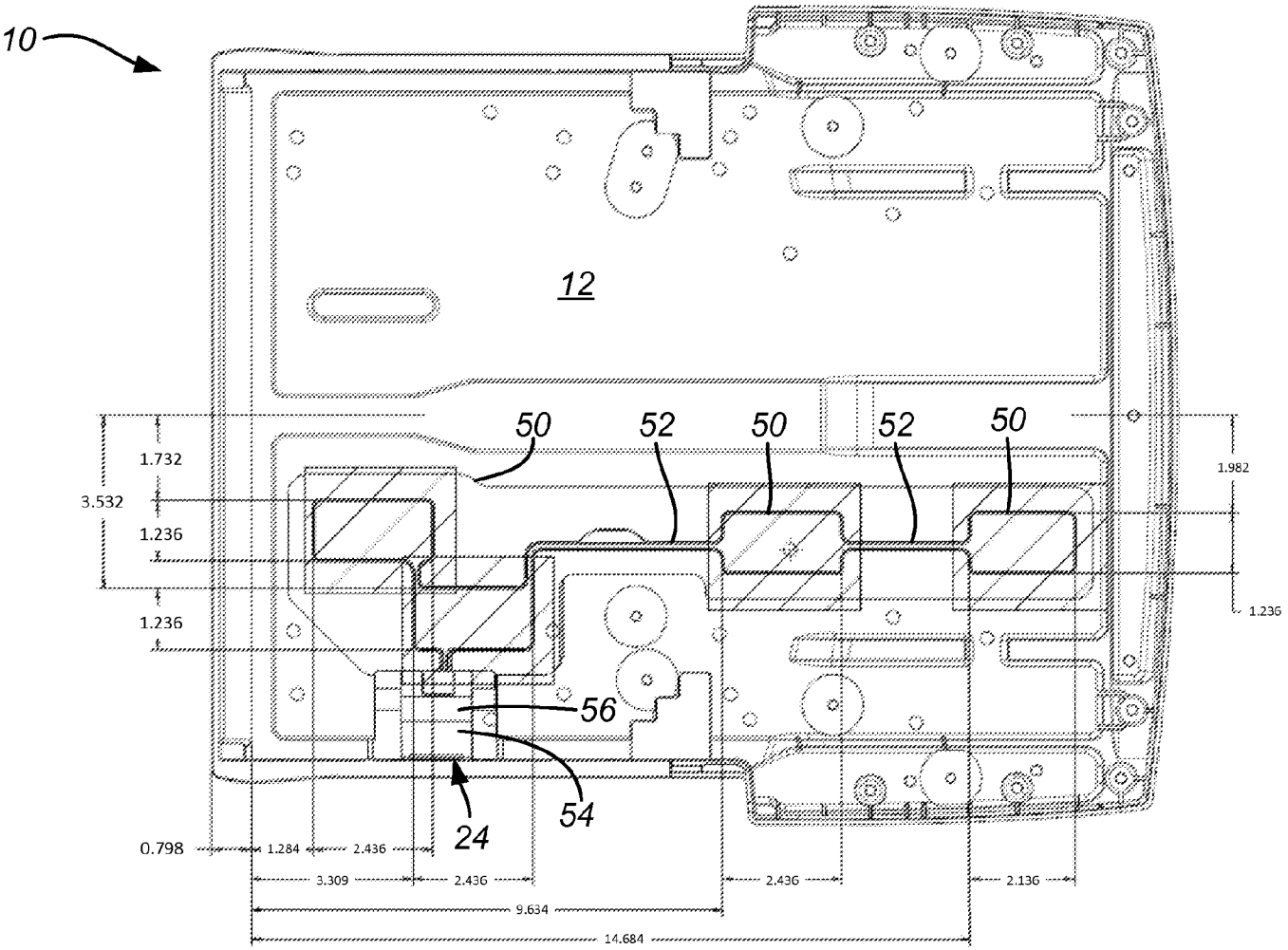
FIG. 7 shows a top view of an alternate embodiment of a media cartridge including a single interrogation antenna configured to establish a plurality of reading regions at different locations along a bottom surface of a media cartridge operatively connected to communicate with a common relay interface.

Another embodiment of the interrogation antenna 22 is shown in FIG. 7. According to the present embedment, a single interrogation antenna 22 is configured to establish a plurality (three in FIG. 7) of reading regions 50 at different locations along a support surface 12 of a media cartridge 10 operatively connected to communicate with a common relay interface 24. The distances shown in FIG. 7 are expressed in inches, and are provided only as an example of the different dimensions of the reading regions 50 and the relatively-low-intensity regions 52 separating those reading regions 50 from each other. The dimensions are not to be considered to be the only suitable dimensions, or limiting the scope of the present disclosure, as different dimensions also fall within the scope of the present application. The dimensions appearing in FIG. 7 are merely illustrative, and are provided simply to highlight the concept that the reading regions 50 generally have greater separation between the material forming the interrogation antenna 22 in those regions than the material forming the interrogation antenna 22 in the low-intensity regions 52 between the reading regions 50.

Each of the relay antenna 28 and the interrogation antennas 22 can optionally be connected to the relay interface 24 using electronics (referred to generally at 54 in FIG. 7) to match the impedance of those antennas to the impedance of the relay interface 24. This matching can be performed using a process referred to as "tuning" or "impedance matching" that is widely known in the art. The purpose of tuning is to maximize power transfer from one antenna to the other, maximize signal integrity of the system, and minimize signal reflections at the interfaces between the relay interface 24 and the antennas 28, 22. The tuning can be performed once the entire system positioned in the final orientation in the product or environment in which the system is expected to operate (e.g., once the cartridge 10 has been fully inserted into the imager 32 and is in position for use to produce hardcopies onto the medium in the cartridge 10). This way, any effects of surrounding metal or other objects will be taken into account in the final tuning values.

The relay interface 24 or other portion of the present system can also include an amplifier, repeater, or other device (generally referred to at 56 in FIG. 7) to repeat the signal and/or amplify the power transmitted between the relay antenna 28 and the interrogation antenna 22. This device 56 would typically be powered by an energy source independent of the relay antenna 28 (e.g., powered by a source of electric energy such as a battery, or power supply provided to the imager 32, for example, that does not consume the current induced in the relay antenna 28).

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A container for transporting a consumable, the container comprising:

a support surface on which the consumable to be introduced to a receiving apparatus is supported;

a reading component coupled to the support surface to read a computer-readable code;

wherein the consumable comprises sheets of a flexible imager medium on which content is to be printed, the sheets of the flexible imager medium being supported on the support surface, within a recess substantially surrounded by a perimeter wall in a manner to be retrieved from the recess by an imager, and being formed from at least one of film and paper;

a tag supporting the computer-readable code among the sheets of the flexible imager medium in the recess; and a relay interface operatively connected to the reading component to: (i) receive a signal indicative of the computer-readable code read by the reading component, and (ii) transmit information indicative of the computer-readable code via a wireless communication channel to convey information about the computer-readable code read by the reading component to the receiving apparatus, the relay interface being coupled to the container at a location remotely located from the reading component and having an orientation that is different from an orientation of the reading component.

2. The container of claim 1 further comprising a perimeter wall oriented at an angle greater than ten (10°) degrees relative to the support surface, wherein the relay interface is supported adjacent to the perimeter wall and the reading component is supported adjacent to the support surface.

3. The container of claim 2, wherein:

the reading component comprises a first antenna comprising a first coil wound in a plane that is substantially parallel with the support surface, and the relay interface comprises a second antenna comprising a second coil wound in a plane that is substantially parallel with the perimeter wall.

4. The container of claim 2, wherein the angle is greater than or equal to forty five (45°) degrees relative to the support surface, and the perimeter wall extends longitudinally along a periphery of the support surface.

5. The container of claim 2, wherein the angle is approximately ninety (90°) degrees relative to the support surface, and the perimeter wall extends longitudinally along a periphery of the support surface.

6. The container of claim 1 further comprising a hardwired connection extending between the reading component and the relay interface.

7. The container of claim 1 further comprising a second reading component operatively connected to the relay interface and coupled to the support surface at a second location that is different from a location of the reading component, wherein the reading component and the second reading component are arranged along the support surface to read different computer-readable codes at different positions relative to the consumable provided to the container.

8. The container of claim 1, wherein the relay interface comprises an antenna through which a current is inductively generated by an alternating field emitted by the compatible reader provided to the receiving apparatus, the relay interface being adapted to transmit a signal to be received by the reading component to initiate reading of the computer-readable code in response to the current.

9. The container of claim 8, wherein the reading component comprises a radio-frequency antenna that transmits an interrogation signal in response to receiving the signal transmitted by the relay interface to energize a RFID antenna storing the computer-readable code provided to the consumable.

10. The container of claim 1, wherein the reading component comprises a continuous antenna that is configured to form a plurality of different reading regions at different locations of the support surface.

11. A media cartridge storing a consumable medium on which content is to be rendered utilizing a hardcopy production apparatus for generating a hardcopy of the content, the media cartridge comprising:

a housing comprising a support surface on which the consumable medium rests and a perimeter wall that extends upwardly, from a portion of a periphery of the support surface to define a cavity in which the medium is to be stored for consumption by the hardcopy production apparatus;

wherein the consumable medium comprises sheets of a flexible imager medium on which content is to be printed, the sheets of the flexible imager medium being supported on the support surface, within a rectangular recess substantially surrounded by the perimeter wall in a manner to be retrieved from the recess by the hardcopy production apparatus, and being formed from at least one of film and paper;

a tag supporting the computer-readable code among the sheets of the flexible imager medium in the recess;

a first reading component coupled to the housing and comprising an interrogation antenna that emits an interrogation signal in response to being energized to read a computer-readable code stored by a storage device accompanying the consumable medium, the interrogation antenna comprising a first orientation relative to the housing; and a relay interface operatively connected to communicate with the first reading component and comprising a relay antenna in a second orientation relative to the housing that is different from the first orientation of the interrogation antenna, wherein, in response to the relay antenna receiving a wireless signal, the relay interface transmits an energizing signal to energize the interrogation antenna and initiate reading of the computer-readable code.

12. The media cartridge of claim 11, wherein the interrogation antenna is coupled to the support surface, inward of the perimeter wall extending along the portion of the periphery of the support surface, and the relay antenna is coupled to the perimeter wall, at the periphery of the support surface.

13. The media cartridge of claim 11, wherein the interrogation antenna is arranged to be substantially parallel with a major plane of the consumable medium supported by the support surface, and the relay antenna is approximately orthogonal to the interrogation antenna.

14. The media cartridge of claim 11 further comprising a second reading component operatively connected to the relay interface and coupled to the support surface at a second location inward of the perimeter wall that is different from a location of the first reading component.

15. The media cartridge of claim 14 further comprising a hardwired connection extending between each of the first and second reading components and the relay interface.

* * * * *